United States Patent [19]

Ebnesajjad et al.

[11] Patent Number: 4,668,453

[45] Date of Patent: May 26, 1987

[54] COSPINNING PROCESS

[75] Inventors: Sina Ebnesajjad; Eugene G. Jones, both of Martinsville, Va.

[73] Assignee: E. I. Du Pont de Nemours and Company, Wilmington, Del.

[21] Appl. No.: 702,065

[22] Filed: Feb. 15, 1985

[51] Int. Cl.[4] ..... D01F 1/02

[52] U.S. Cl. ..... 264/78; 264/210.6; 264/210.8; 264/211.14

[58] Field of Search ..... 264/171, 176 F, 211.14, 264/211; 425/463

[56] References Cited

U.S. PATENT DOCUMENTS

| | | | |
|---|---|---|---|
| 3,018,272 | 1/1962 | Griffing et al. | 264/176 F |
| 3,681,910 | 8/1972 | Reese | 264/103 |
| 3,707,522 | 12/1972 | Simons | 260/37 NP |
| 3,900,676 | 8/1975 | Alderson | 264/210.8 |

*Primary Examiner*—Jan H. Silbaugh
*Assistant Examiner*—Hubert C. Lorin

[57] ABSTRACT

Cospun yarn essentially free of mechanical defects comprising from about 30 to about 70 weight percent of poly(ethylene terepthalate) filaments containing a basic dye sensitizing unit and the remainder of the filaments being copolyamide filaments of hexamethylene adipamide and small amounts of carpoamide.

1 Claim, 1 Drawing Figure

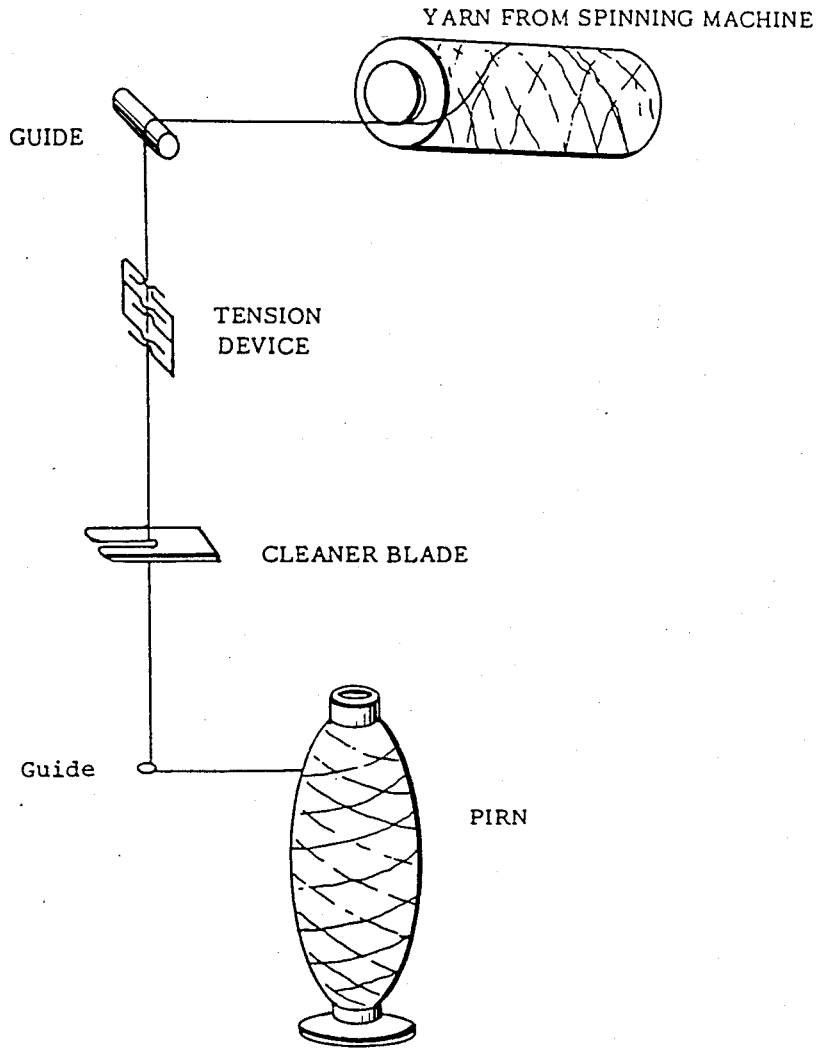
FIGURE

COSPINNING PROCESS

BACKGROUND OF THE INVENTION

1. Field of the Invention

This invention relates to a cospun yarn comprising poly(hexamethylene adipamide/caproamide) (nylon 6,6/6) filaments and certain basic dyeable polyester filaments and to a process for making such yarn.

2. Description of the Prior Art

The desirability of cospinning poly(hexamethylene adipamide) and poly(ethylene terephthalate) filaments which may contain basic dye sensitizing units is disclosed in Reese U.S. Pat. No. 3,681,910. Cospun yarn comprising a major amount up to about 70 weight percent of poly(ethylene terephthalate) filaments with the remainder being poly(hexamethylene adipamide) filaments containing 3 to 10 weight percent of an N-alkyl substituted polycarbonamide is described in copending coassigned U.S. application Ser. No. 432,443 filed Oct. 4, 1982. A need for making the polyester component of such cospun yarn basic dyeable prompted efforts to incorporate basic dye sensitizing units into the polyester chain following the teachings of U.S. Pat. No. 3,018,272. It was found however, that attempts to cospin the modified polyester with nylon 6,6 resulted in an intolerable number of mechanical yarn defects. It is an object of this invention to provide a cospun yarn containing the modified polyester and having only a minor proportion of mechanical defects.

SUMMARY OF THE INVENTION

This invention provides a cospun yarn essentially free of mechanical defects comprising from about 30 to about 70 weight percent of poly(ethylene terephthalate) filaments containing within the polymer chain from about 0.5 to 10 mol percent based on the repeat units of the polyester chain, of units of the structure.

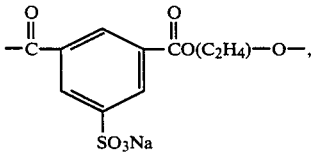

with the remainder of the filaments being copolyamide filaments consisting essentially of hexamethylene adipamide and caproamide units wherein the caproamide units comprise from about 3 to 12 mol percent of the copolyamide and a process for preparing the yarn.

THE FIGURE

The FIGURE is a schematic of the system used to determine mechanical defects in the yarn.

DETAILED DESCRIPTION OF THE INVENTION

The cospun yarn of the invention may be prepared in accordance with th techniques described in Reese U.S. Pat. No. 3,681,910. Basically, the two fiber-forming polymeric compositions are separately fed to one or more spinning assemblies and extruded to form groups of discrete filaments from each of the polymer compositions in the desired proportions. The filaments are then combined into a single composite yarn and drawn as an integral yarn. The filaments of the yarn are of textile denier, preferably from 1 to 10 denier per filament (dpf).

The two fiber-forming polymeric compositions employed in the present invention are poly[ethylene terephthalate/(5-sodium sulfo-)isophthalate] hereinafter 2GT/SSI and poly(hexamethylene adipamide/caproamide) hereinafter nylon 6,6/6. The desired yarn contains at least about 30% by weight of copolyester filaments preferably about 60% by weight, but no more than 70% by weight, with the remaining filaments in the yarn being constituted by the copolyamide filaments.

The copolyamide employed herein consists essentially of hexamethylene adipamide units and from about 3 to 12 mol percent of caproamide units. Methods for preparing the copolyamide are well known in the art. For the examples which follow a batch polymerization process is used to produce the nylon 6,6/6 copolymer. Nylon 6,6 salt and caprolactum are mixed in the evaporation stage and thereafter the process is similar to nylon 6,6 polymerizations of the prior art.

About 3 to 10 weight percent of an N-alkyl substituted polycarbonamide in which the tertiary carbonamide groups are an integral part of the polymer molecule is added to the copolyamide filaments to impart antistatic qualities. Useful modifiers have a molecular weight of at least about 800 to 5000 and are dispersed throughout the filament substantially as a separate phase in the form of discrete elongated conductive particles aligned essentially parallel to the filament axis, all as described in Alderson U.S. pat. No. 3,900,676. The elongated conductive particles should have a ratio of their length, L, to average diameter, D, of at least about 100 as taught in said Alderson patent.

In preparing the products of the present invention, the N-alkyl polycarbonamide, if employed, may be mixed directly with the fiber-forming copolyamide and then immediately spun into filaments. If desired, it may be combined with polymer flake and then spun into filaments. Less reactive N-alkyl polycarbonamides can be introduced into the autoclave during production of the fiber-forming polycarbonamide. Preferably, the N-alkyl polycarbonamide and fiber-forming nylon 6,6/6 are mixed in molten condition and immediately spun into filaments. Particularly useful N-alkyl polycarbonamides are disclosed in column 3 line 7 through line 21 of column 4 of U.S. Pat. No. 3,900,676. In the Examples I and II which follow, the modifier employed is the reaction product of a mixture of 80% N,N'-di-n-butyl hexamethylene diamine and 20% of mono-N-butyl hexamethylene diamine and dodecanedioic acid. Stearic acid is employed as a viscosity stabilizer. The modifier had a melting point less than 0° C., a calculated molecular weight of about 2100 and a viscosity of 1100 centistokes at 95° C.

The copolyester employed herein consists essentially of ethylene terephthalate units and from about 0.5 to 10 mol percent of units of the formula

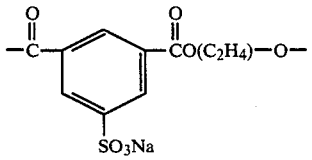

as shown in U.S. Pat. No. 3,018,272. The latter unit is derived from sodium 3,5-di(carbomethoxy) benzene sulfonate which is added to the polyester forming mix as shown in said U.S. Pat. No. 3,018,272.

The cospun yarns of the examples which follow were prepared following the general procedures described in the aforementioned Reese patent. In Examples I and II, one filament group of the mixed filament yarn is 2GT/SSI filaments while the other is polyamide filaments the latter having incorporated therein the antistat modifier mentioned above. The antistat modifier was injected into the polyamide stream shortly before extrusion by injection of the modifier into a screw melter-extruder and mixing before the melt-spinning operation.

Cospinning is achieved by separately metering the copolyester and the copolyamide to two separate inlet ports of a melt spinning assembly designed to accommodate the two streams and keep them separate. The polymers are melt-spun through a spinneret at a temperature in the range of about 278° C. to 285° C. The two groups of filaments merge and are then drawn preferably between about 1.5 to 2.5× and wound up in a package. Details are given in the examples.

The system used to determine mechanical defects is shown in the schematic. In the FIGURE a tube of yarn from the spinning machine is backwound by passage over a guide, through a tensioning device followed by a cleaner blade and on to a pirn. It is at the cleaner blade where a tangle of filaments appears when there are broken filaments in the yarn which are stripped back.

TEST PROCEDURES

Mechanical quality defect level of yarn was measured via back-winding each item from tubes (24 to 48) to pirns. During the back-winding, yarn was passed through a cleaner blade (see FIGURE). The opening of these cleaner blades is 0.0025 inch, slightly larger than the diameter of yarn bundle which is 0.0020 inch. A mechanical quality defect consists of one or more broken filaments of the yarn, which due to stripping back forms a small tangle of filaments. These defects are captured in the cleaner blade and each defect is physically counted. The length of yarn is calculated based on the weight of the yarn which is collected on pirns. The final results are calculated and reported as the number of mechanical defects which occur per one million yards of yarn.

Relative viscosity, RV, of polyester as used in the following examples is the ratio of the viscosity of a 4.75 weight percent solution of polyester in hexafluoroisopropanol to the viscosity of the hexafluoroisopropanol per se, measured in the same units at 25° C. The RV of polyamide is measured as described in U.S. Pat. No. 3,681,910 at column 3, lines 25–30.

EXAMPLE I

Cospun yarns of trilobal 2GT/SSI polyester copolymer filaments (60% by weight) and trilobal nylon 6.6/6 filaments (40% by weight) were prepared from random nylon 6.6/6(95/5) mol % copolymer (40.6 R.V. with 0.02% $TiO_2$) containing 3.0% by weight of antistat modifier and from 2GT/SSI (98/2) mol % polyester copolymer (14.4 R.V. with 0.3% $TiO_2$). The polymers were melt spun at 283° C. simultaneously through holes of a single spinneret into a yarn (6 filaments of each polymer). Finish was applied and the filament streams were converged to a feed roll operating at 1720 ypm (yards per minute) surface speed and then through a steam jet to a pair of draw rolls (about 8 wraps) operating in a hot air (115° C.) chest at a surface speed of 3200 ypm for a draw ratio of 1.86. The drawn yarn was passed through an interlace jet at 55 psig (pounds per square inch gauge) air and wound up on tubes at 3175 ypm at a tension of 7.5 grams. The yarn denier was 40 of which the copolyamide filaments had a denier of 2.7 each and the copolyester filaments a denier of 4 each. The percent elongation was 41.1, tenacity was 3 gpd (grams per denier) and the mechanical defect level of such yarns is reported at Item 1 on Table I below.

EXAMPLE II CONTROL

In a process similar to that of Example I, cospun yarns of trilobal 2GT/SSI polyester copolymer filaments (60% by weight) and trilobal nylon 6.6 filaments (40% by weight) were prepared from nylon 6,6 (41.2 R.V. with 0.02% $TiO_2$) and from 2GT/SSI(98/2) polyester copolymer (14.4 R.V. with 0.3% $TiO_2$). The polymers were melt spun at 292° C. simultaneously through holes of a single spinneret into a yarn (6 filaments of each polymer). Finish was applied and the filament streams converged to a feed roll operating at 1600 ypm surface speed and then through a steam jet to draw rolls as in Example I operating in a hot air (130° C.) chest, at a surface speed of 3200 ypm for a draw ratio of 2.00. The drawn yarn was passed through an interlace jet at 55 psig air and wound up on tubes at 3175 ypm at a tension of 7.5 grams. The yarn denier was 40, percent elongation was 45.1, tenacity was 3 gpd and the mechanical defect level of such yarns reported at Item 2 on Table I below.

Attempts to melt spin the polymers at a melt spinning temperature of 283° C. (as in Example I) failed due to frequent spinning interruptions which prevented accumulation of this yarn on tubes.

TABLE I

| Item | Defect Level Frequency per million yards |
|---|---|
| 1 | 0.6 |
| 2 | 4.7 |

EXAMpLE III

The process of Example I is generally followed except that no antistat modifier is used. A satisfactory cospun yarn is obtained.

We claim:

1. In a process for making a drawn cospun yarn comprising filaments of from 1 to 10 denier per filament (dpf), comprising from about 30 to about 70 weight percent of poly(ethylene terephthalate) filaments containing within the polymer chain from about 0.5 to 10 mol percent based on the repeating limits of the polyester chain, of units of the structure

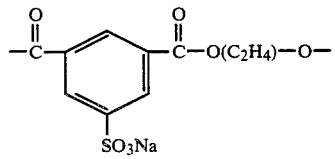

with the remainder of the filaments being polyamide filaments, wherein the copolyester and the polyamide are separately metered to separate inlet ports of a melt spinning assembly and the polymer streams are simultaneously discharged at a temperature in the range of about 278° C. to 285° C. through separate holes of a single spinneret into a yarn and the yarn is drawn between about 1.5 to 2.5× and wound up, the improvement comprising employing as the polyamide feed, a copolyamide consisting essentially of hexamethylene adipamide and caproamide units wherein the caproamide units comprise from about 3 to 12 mole percent of the copolyamide, whereby the cospun yarn is essentially free of defects.

* * * * *